US006863080B2

(12) United States Patent
Clatanoff et al.

(10) Patent No.: US 6,863,080 B2
(45) Date of Patent: Mar. 8, 2005

(54) LIQUID SPRAY DEVICE AND METHOD FOR CLEANING OPTICAL SURFACES

(75) Inventors: William J. Clatanoff, Austin, TX (US); Larry R. Cox, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 320 days.

(21) Appl. No.: 10/022,780

(22) Filed: Dec. 13, 2001

(65) Prior Publication Data

US 2003/0111094 A1 Jun. 19, 2003

(51) Int. Cl.[7] ..... B08B 3/02; B08B 5/00
(52) U.S. Cl. ..... 134/104.2; 134/198; 15/302
(58) Field of Search ..... 134/104.2, 166 R, 134/167 R, 168 R, 169 R, 172, 174, 198, 200; 15/302, 322, 345

(56) References Cited

U.S. PATENT DOCUMENTS 4,733,428 A * 3/1988 Malinge et al. ..... 15/302
4,814,794 A * 3/1989 Sato ..... 347/28
5,332,157 A 7/1994 Proctor
5,557,696 A 9/1996 Stein
5,836,031 A 11/1998 Cox ..... 15/104.002
5,922,141 A * 7/1999 Darsey ..... 134/15
5,956,793 A 9/1999 Cox ..... 15/104.002
6,006,768 A * 12/1999 Cox ..... 134/200
6,125,227 A * 9/2000 Cox ..... 385/134
6,209,162 B1 4/2001 Clairadin et al. ..... 15/97.1
2002/0162582 A1 * 11/2002 Chu et al. ..... 134/105

FOREIGN PATENT DOCUMENTS

WO WO 9840769 A2 * 9/1998 ..... G02B/6/00

OTHER PUBLICATIONS

Search Report for PCT/US02/32347.

* cited by examiner

*Primary Examiner*—Frankie L. Stinson
*Assistant Examiner*—Joseph L. Perrin
(74) *Attorney, Agent, or Firm*—Melanie G. Gover

(57) ABSTRACT

A portable, self-contained spray device and method for reaching and cleaning at least one optical surface having limited access. The spray device includes a fluid reservoir and a cover tube having an inner wall, an outer wall, a first end and a second end. A nozzle assembly at the first end of the cover tube includes a seal to provide substantially fluid-tight contact between the spray device and an optical surface. A delivery tube is located inside the inner wall of the cover tube, coaxial with the cover tube. The delivery tube coupled to the fluid reservoir directs fluid towards the nozzle assembly. An absorbent mounted adjacent to the outer wall of at least a portion of the cover tube collects liquid residues after application of fluid to an optical surface. The absorbent may be included in an absorbent cartridge that includes a detachable jacket surrounding the absorbent.

9 Claims, 3 Drawing Sheets

LIQUID SPRAY DEVICE AND METHOD FOR CLEANING OPTICAL SURFACES

FIELD OF THE INVENTION

The invention relates to a liquid spray device for cleaning an optical surface. More particularly the present invention provides a portable, self-contained, spray-cleaning device designed to reach optical surfaces, especially multiple, grouped optical fiber surfaces, that would otherwise be difficult to access.

BACKGROUND OF THE INVENTION

Optical fibers are well known as carriers of data and communication signals. The development of associated devices, utilizing fiber optic links, has led to the multiplication of interconnections among optical fibers. Miniaturization of optoelectronic devices produced fiber optic interconnecting structures containing multiple optical fiber tips suitable for incorporation into backplanes of switching equipment. The use of optical fiber on backplanes presents a unique set of problems including problems of optical fiber alignment and maintaining the cleanliness of optical fiber surfaces. One issue of alignment affects optimal positioning of daughter card fiber optic connectors and receiving connectors located on the backplane. Misalignment of optical fiber ends may cause attenuation of light signals passing through a connection zone between optical fibers. Optical fiber surface cleanliness becomes a problem during disconnection of optical links when exposed ends of optical fibers become susceptible to surface contamination. This problem is difficult to eliminate when optical fiber connector surfaces reside recessed in a narrow bore or in relatively inaccessible locations within a backplane. The presence of obscuring coatings or dirt particles at the interface between connected optical fibers impedes the passage of light. In the case of single mode fiber products, for example, the working diameter of the fiber is <10 microns and even a small dust particle could cause significant loss in signal.

It is known that the connecting surfaces of optical fibers should be maintained in a highly clean condition, free from contamination. Common causes of contamination include dust, finger oil, skin flakes, and the like. Some contaminants may be easily removed with a dry cleaner, including a dry or moistened lintless wipe or by directing a jet of clean compressed gas towards loose particles to displace them from the surface of the optical fiber. More resistant contaminants such as skin oil require solvent cleaners that may be applied as a pressurized liquid spray. U.S. Pat. No. 4,733,428 describes a liquid spray cleaning tool adapted to clean optical surfaces for which access is difficult. The cleaning tool includes an injector, which directs a cleaning liquid, and then a drying gas, under pressure towards the optical surface. An evacuation jacket removes cleaning and drying fluids after application. The tool has a neck to fit onto an optical tip associated with a single optical fiber. There is nothing to suggest that this tool is either portable or self-contained or useful with multiple fibers. Although not described in detail, there appears to be a need for an auxiliary source of reduced pressure to remove fluid residue from the vicinity of an optical surface after cleaning by this tool.

Other methods for cleaning optical fiber surfaces include both dry and wet cleaning methods. Such methods include the use of a solvent rinse, compressed gas, and physical contact of optical fiber ends that may be contained in the ferrules of optical fiber connectors. U.S. Pat. Nos. 5,836,031, 5,956,793, 6,006,768, and 6,125,227 address a device for cleaning an optical fiber involving the deposit of a cleaning substance on a surface to be cleaned, particularly an optical surface such as a surface of an optical fiber. Description is given of application of both wet and dry substances. The cleaning device is selectively positionable for cleaning the tips of optical fibers, which have been installed in a connector, such as a plug or a receptacle. A cleaning device includes a tool body having either a cleaning fluid or substantially dry cleaning media therein, such as a strip of adhesive tape. The adhesive tape may be in the form of a roll on a supply spool. Alternate designs use cleaning media not located in the tool body, but applied manually to optical fibers. Previously described methods are effective primarily for cleaning readily accessible optical surfaces.

Removal of contaminants becomes more difficult when optical fibers, that require cleaning, occupy a relatively inaccessible location such as a backplane buried inside a narrow slot through a switch card cage, at distances of sixteen inches or more. The inconvenience of removing optical fibers from backplanes, once installed, establishes the need for tools and techniques with which to accomplish remote cleaning of optical fiber surfaces during access to a switch card cage. U.S. Pat. No. 6,209,162 addresses this problem using a system for cleaning the end of a ferrule of a fiber optic connector mounted on a backplane of a chassis adapted for receiving a printed circuit board having a mating connector mateable with the fiber optic connector. A dummy circuit board is receivable by the chassis to replace the actual printed circuit board. A cleaner, mounted on the dummy circuit board, cleans the end of the ferrule of the fiber optic connector during insertion of the dummy board in a card slot. This solution brings with it the potential requirement for a custom fabricated dummy circuit board according to the dimensions of any structure containing a fiber optic surface that needs to be cleaned. Also, the method uses a strip of material moving only in one direction.

A need exists for relatively simple tools and processes to facilitate cleaning of inaccessible optical fiber surfaces for optimum transmission of light signals.

SUMMARY OF THE INVENTION

The present invention provides a portable, self-contained, spray-cleaning device designed to reach optical surfaces, especially multiple, grouped optical fiber surfaces, that would otherwise be difficult to access. Cleaning of optical surfaces according to the present invention requires a liquid spray device in the form of an elongate cylinder or wand that has a fluid rinse tool or nozzle assembly at one end to wash optical surfaces, preferably connecting surfaces of optical fiber ends. A central portion of the spray wand includes a fluid collector that uses an absorbent to collect fluid residues produced during operation of the nozzle assembly. Fluid for application using the nozzle assembly may be held in a reservoir attached to the end of the spray device opposite the nozzle assembly. Alternatively, a coupling may be provided opposite the spray nozzle assembly to attach an external fluid reservoir to the spray wand. The nozzle assembly includes a seal for contact with an optical surface to limit spray application to that surface while preventing contamination of surrounding components and other optics due to overspray or fluid splashing. In addition the seal provides operator safety by preventing adverse exposure of a user to cleaning fluid.

A liquid spray device according to the present invention preferably delivers a rapid-drying cleaning fluid such as HFE. The device includes a spray cleaning wand or elongate cover tube adapted to reach through narrow openings to facilitate cleaning of surfaces that would otherwise be inaccessible. Preferably, materials used in the construction of this cleaning tool have sufficient conductivity to bleed accumulated static charge to ground. The benefits of suitable material selection and conventional grounding means, such as grounding cords, tethers and the like, may be used to prevent any incidence of electrostatic damage between the cleaning article and circuit components. Thereafter, the tool and associated cleaning process may be applied for cleaning fiber optic ferrules, located in a backplane, mounted inside a switch card cage.

More particularly the present invention provides a spray device for cleaning at least one optical surface having limited access thereto, the spray device comprising a fluid reservoir communicating with a nozzle assembly, to deliver liquid spray to an optical surface. The spray device also includes an absorbent to collect liquid residues from the liquid spray.

A preferred embodiment of the present invention provides a portable, self-contained spray device for cleaning at least one optical surface. The spray device comprises a fluid reservoir and a cover tube having an inner wall, an outer wall, a first end and a second end. A nozzle assembly at the first end of the cover tube includes a seal to provide substantially fluid-tight contact between the spray device and an optical surface. A delivery tube is located inside the inner wall of the cover tube, coaxial with the cover tube. The delivery tube coupled to the fluid reservoir directs fluid towards the nozzle assembly. An absorbent mounted adjacent to the outer wall of at least a portion of the cover tube collects liquid residues after application of fluid to an optical surface. The absorbent may be included in an absorbent cartridge that comprises a detachable jacket surrounding the absorbent.

The present invention further includes a process for cleaning at least one optical surface having limited access thereto. The steps of the process include providing at least one optical surface having limited access thereto; reaching the surface to wipe a dry cleaner against it to provide a wiped optical surface and applying a liquid cleaner to the wiped optical surface using a liquid spray device. The liquid spray device comprises a fluid reservoir communicating with a nozzle assembly that reaches to the optical surface to deliver liquid spray thereto. The spray device also includes an absorbent to collect liquid residues departing from the at least one optical surface after application by the liquid spray device.

Terms used herein have the meanings indicated by the following definitions.

The term "HFE" refers to a hydrofluoroether cleaning fluid (available from Minnesota Mining and Manufacturing Co., St. Paul, Minn. as 3M™ HFE-7100) used for precision cleaning, electronics cleaning, and metal cleaning. Other cleaning fluids may be used, particularly those that evaporate rapidly after application.

Terms such as "relatively inaccessible" or "difficult to access" and the like refer to the positioning of target surfaces inside containment structures so as to impede contact with the surfaces unless adaptive systems are available to circumvent the impediments.

The terms "cover tube" and "wand" refer herein to a central tube that contains a delivery tube and provides a link between a nozzle assembly and a fluid reservoir.

An "absorbent" is any material capable of capturing a liquid for later disposal or for removal from a liquid spray device according to the present invention by evaporation. Preferred materials include absorbent powders, porous woven fabrics, non-woven fibrous materials, and foamed materials including sponges.

The term "optical surface" refers to a surface of a light transparent material that requires periodic cleaning for optimum light transmission. As used herein a preferred optical surface is an end portion of optical fibers that are usually positioned in fiber optic connecting structures to facilitate passage of optical signals between lengths of optical fiber. The present invention may be adapted to clean a single optical fiber end or a plurality of optical fiber ends grouped together in a single fiber optic connection.

An "orifice" or "nozzle orifice" represents any one of a number of shaped openings formed in spray nozzle to release a liquid spray pattern. The pattern corresponds to the location of a single optical surface, that may reside at a single point, or a grouped pattern of optical surfaces such as fiber optic ends included in a fiber optic connector.

The beneficial effects described above apply generally to the exemplary devices and mechanisms disclosed herein of the cleaning device used to reach inaccessible optical surfaces to recondition them for optimal transmission of light signals. The specific structures through which these benefits are delivered will be described in detail hereinbelow.

BRIEF DESCRIPTION OF THE DRAWINGS

Notwithstanding any other forms, which may fall within the scope or the present invention, preferred forms of the invention will now be described, by way of example only, with reference to the accompanying drawings in which.

DETAILED DESCRIPTION OF THE PREFERRED EMBODIMENT

As required, details of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled;" this terminology's use contemplates elements being connected together in such a way that there may be other components interstitially located between the specified elements, and that the elements so specified may be connected in fixed or movable relation one to the other.

Figure 1:
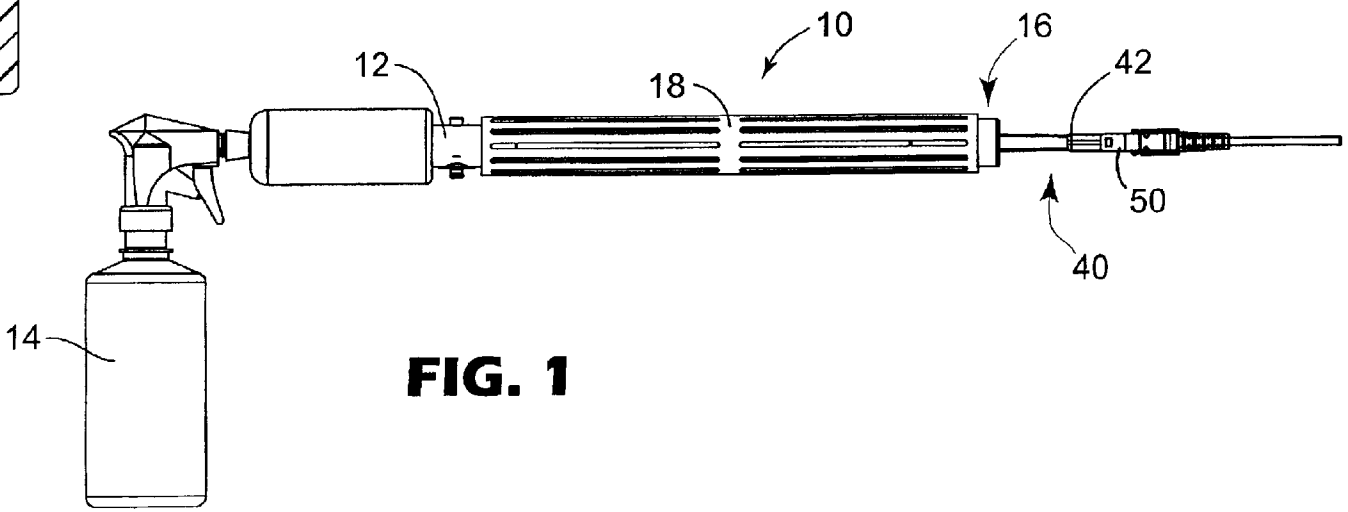
FIG. 1 provides a side view of a liquid spray device according to the present invention.

Referring now to the figures wherein like numbers represent like parts throughout the several views, FIG. 1 shows a liquid spray device 10 that is useful for spray cleaning optical surfaces. The liquid spray device 10 is a portable, self-contained unit comprising an elongate tube referred to herein as a cover tube or wand 12 having a selected diameter and length. Cover tubes 12 may be fabricated from relatively rigid materials including, metals, fiber reinforced plastics and rigid resins. One of the cover tube ends is adapted for attachment of a fluid container 14 that provides a ready supply of a cleaning liquid. The other end of the cover tube 12 includes a nozzle assembly 16 for receiving an optical surface to provide a seal around the portion of the surface requiring spray cleaning. A detachable jacket 18 surrounds a portion of the cover tube. Suitable materials used to manufacture a detachable jacket 18 include shaped and molded porous structures such as fabrics, perforated metal and plastic structures, and plastic meshes and the like. The combined diameter of the cover tube 12 and the detachable jacket 18 and the selected length of the cleaning device 10 are suitable for reaching through an opening to a buried optical surface, such as an optical connector 50 residing at a relatively inaccessible location inside a switch card cage. A cleaning device 10 having lengthwise adjustment provides a versatile cleaning tool that may expand or contract as needed to reach one or more limited access optical surfaces for cleaning.

Figure 2:
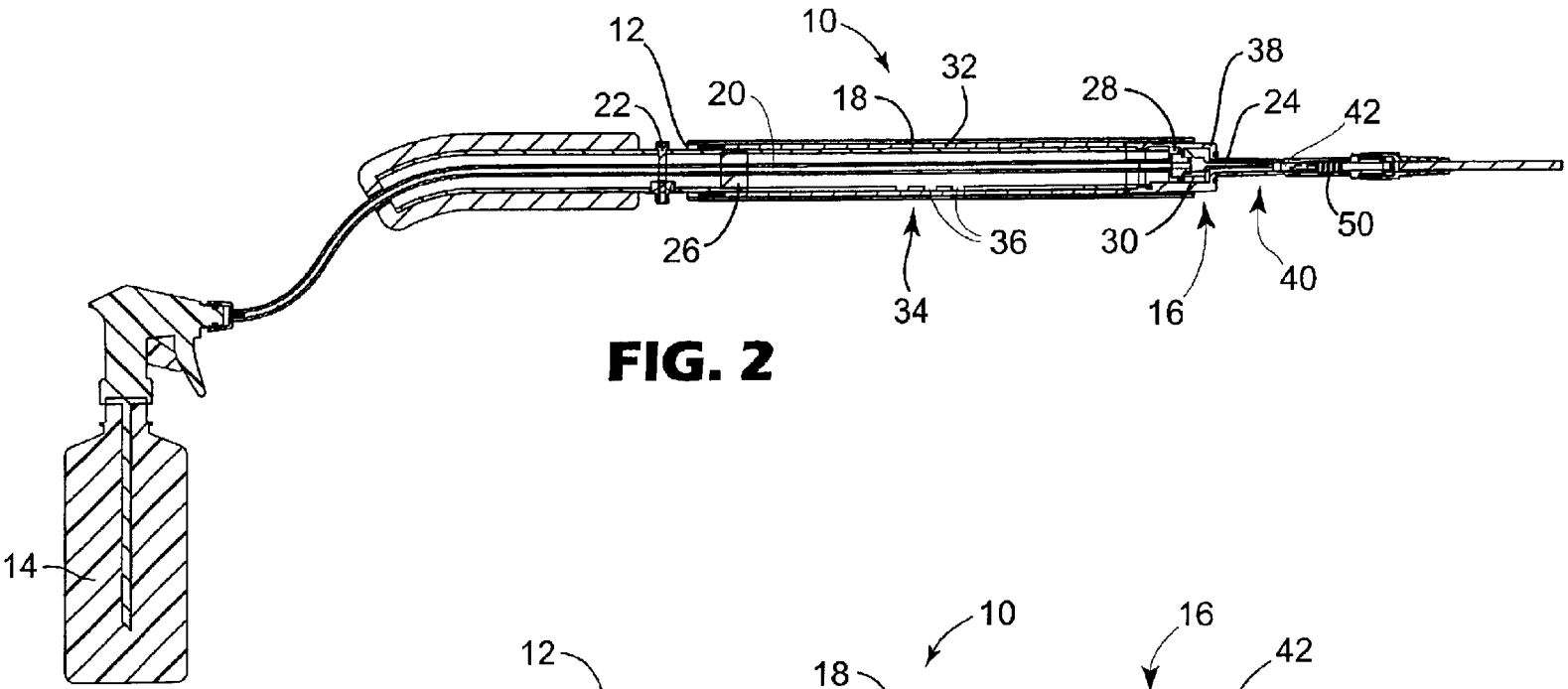
FIG. 2 shows a cross section of a liquid spray device.

FIG. 2 provides a cross sectional view of a liquid spray device 10 according to the present invention, showing the contents of the cover tube 12. As illustrated, a delivery tube 20 extends the length of the cover tube 12. The delivery tube has a coupling 22 at one end for attaching a fluid container 14 to the delivery tube 20. Different means may be used for attaching a fluid container 14. Options include direct attachment as shown in FIG. 1 or attachment means including a flexible hose, as shown in FIG. 2. Other suitable fluid containers or reservoirs and means for attachment fall within the scope of the present invention.

The other end of the delivery tube 20 terminates in the nozzle 24 component of a nozzle assembly 16. A nozzle 24 according to the present invention produces a defined stream of liquid delivered under pressure from the fluid container 14, also referred to herein as a liquid reservoir 14. A liquid reservoir 14 preferably includes a pump to deliver liquid under pressure. The defined stream of liquid may have a variety of cross-sectional shapes including circular for cleaning small individual optical surfaces, such as an end face of an optical fiber, or an oblong slit for cleaning several in-line fiber optic ends. It will be appreciated that the terminal opening or orifice 58 of a nozzle 24 may be adapted to satisfy the needs of any selected grouping of optical surfaces such as those present in a multi-fiber optical fiber connector.

Retention of the delivery tube 20 inside the cover tube 12 requires a fluid tight junction 26 adjacent to the coupling 22 and a support 28 between the cover tube 12 and the delivery tube 20 adjacent to the nozzle 24. The nozzle assembly 16 includes a fluid return channel 30 for collection of liquid residues resulting from application of spray to an optical surface. After passing through the fluid return channel 30 the residual liquid collects in the space between the cover tube 12 and the delivery tube 20.

After repeated use of a liquid spray device 10 it becomes desirable to remove residual liquid from inside the cover tube 12. Removal of liquid residues typically employs suction equipment to withdraw fluid from the temporary reservoir, inside the cover tube. Usually the suction equipment is not part of a conventional spray-cleaning device, which limits the usefulness of such a device. A distinguishing feature of the present invention is its portability and ability to contain liquid residues while at the same time removing them from within the cover tube 12. Liquid residues containment results from the use of a detachable jacket 18 containing an absorbent 32 that may have a fibrous or particulate structure. The detachable jacket 18 occupies a position against a cover tube section 34 that includes a plurality of drain holes 36. Fluid residues passing through the fluid return channel 30 for collection in the cover tube 12 may subsequently pass through drain holes 36 to be captured in the absorbent 32 inside the detachable jacket 18. The use of an absorbent 32 inside a detachable jacket 18 eliminates the need for auxiliary suction equipment to clear liquid residues resulting from spray-cleaning an optical surface.

Figure 3:
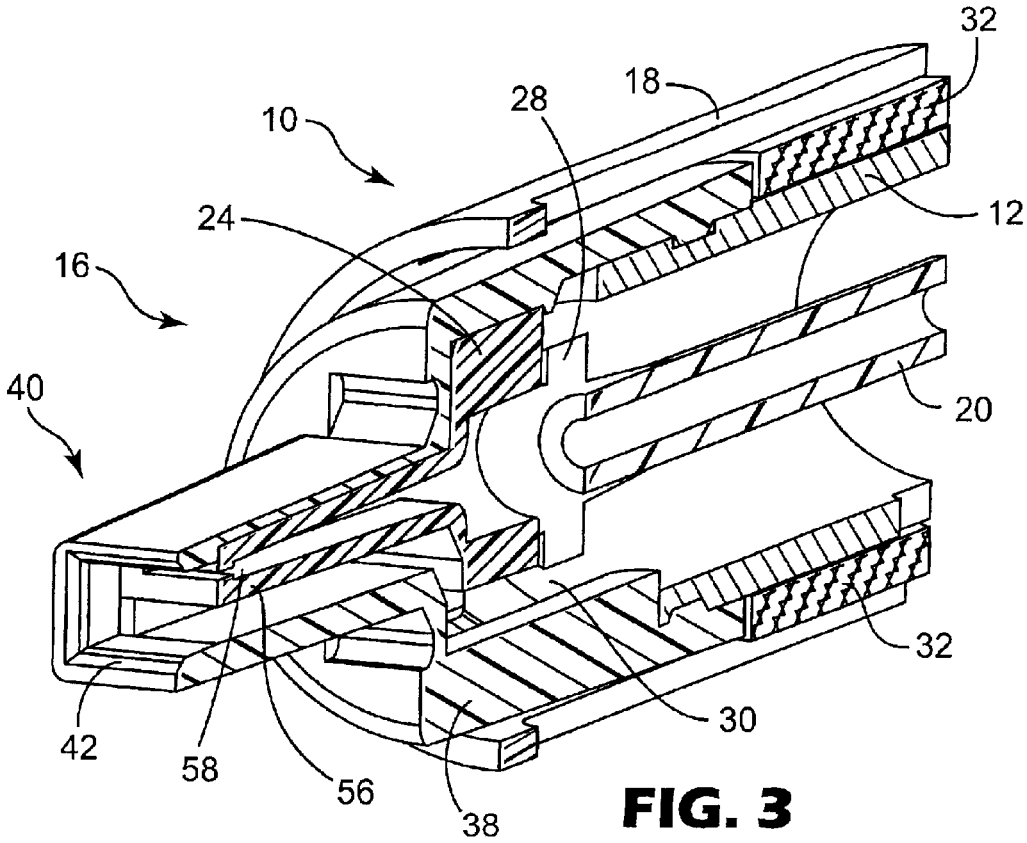
FIG. 3 is a perspective cross section showing a nozzle assembly according to the present invention FIG. 4 provides a partial cutaway view of an absorbent cartridge that includes a detachable jacket surrounding an absorbent for liquid residues.

FIG. 3 provides a perspective cross section of one embodiment of a nozzle assembly 16 according to the present invention. A nozzle assembly 16 includes a molded shroud 38 formed from a flexible, rubbery elastomeric material. Suitable conformable materials for a molded shroud 38 include rubbery polymers such as, natural rubber, polyolefin copolymers and terpolymers, silicone polymers and polyurethane polymers and the like. The shroud 38 mounts on an end of a cover tube 12 and includes a contact end 40 having a peripheral seal 42 to prevent leakage of liquid spray from the inside of the shroud 38 during active spray cleaning of an optical surface. After inserting an optical surface into the contact end 40 of a shroud 38, and preventing fluid leakage using the peripheral seal 42, any liquid dispensed during spray cleaning passes through the return channel 30 for collection by the absorbent 32.

Delivery of liquid spray to an optical surface occurs by movement of liquid from the delivery tube 20 through a nozzle 24 included in the nozzle assembly 16. The nozzle end 56 includes an orifice 58 that shapes the spray pattern according to the number and contours of optical surfaces to be cleaned. Preferred shapes for an orifice according to the present invention include circular, e.g. for an end surface of a single optical fiber, or oblong silt to apply liquid spray to a linear arrangement of several fiber optic surfaces 48.

Figure 4:
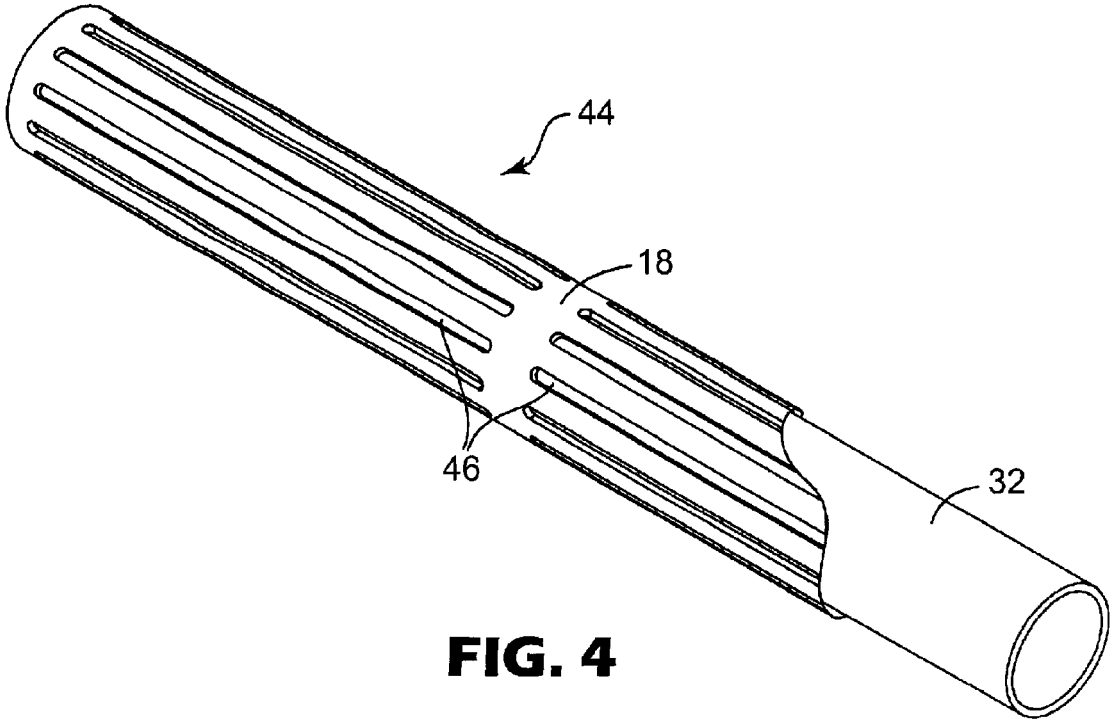

FIG. 4 illustrates an absorbent cartridge 44 that includes absorbent 32 contained inside a detachable jacket 18. Preferably the absorbent 32 comprises a non-woven fibrous material of blown micro-fibers such as environmentally safe sorbent products available from Minnesota Mining and Manufacturing Company, St. Paul, Minn. As discussed previously, an absorbent cartridge 44 provides a suitable means for containing liquid residues produced during operation of a portable liquid spray device 10 according to the present invention. It will be appreciated that absorbent cartridges 44 may require replacement when the absorbent 32 becomes saturated. The absorbent cartridge 44 of FIG. 4 includes longitudinal slits 46 to facilitate evaporation of liquid residues from the absorbent 32. Longitudinal slits provide gaps in a detachable jacket 18 through which evaporating liquid escapes. Gaps may have varying geometries including perforations of circular, elliptical and sinusoidal shapes and the like. Removal of liquid residues by evaporation reduces the frequency of replacement of absorbent cartridges 44 over the cover tube section 34, thereby adding to the convenient portability of liquid spray devices according to the present invention. Further extension of the use of an absorbent cartridge results from the use of fugitive liquids such as hydrofluoroethers of which HFE is preferred.

Figure 5:
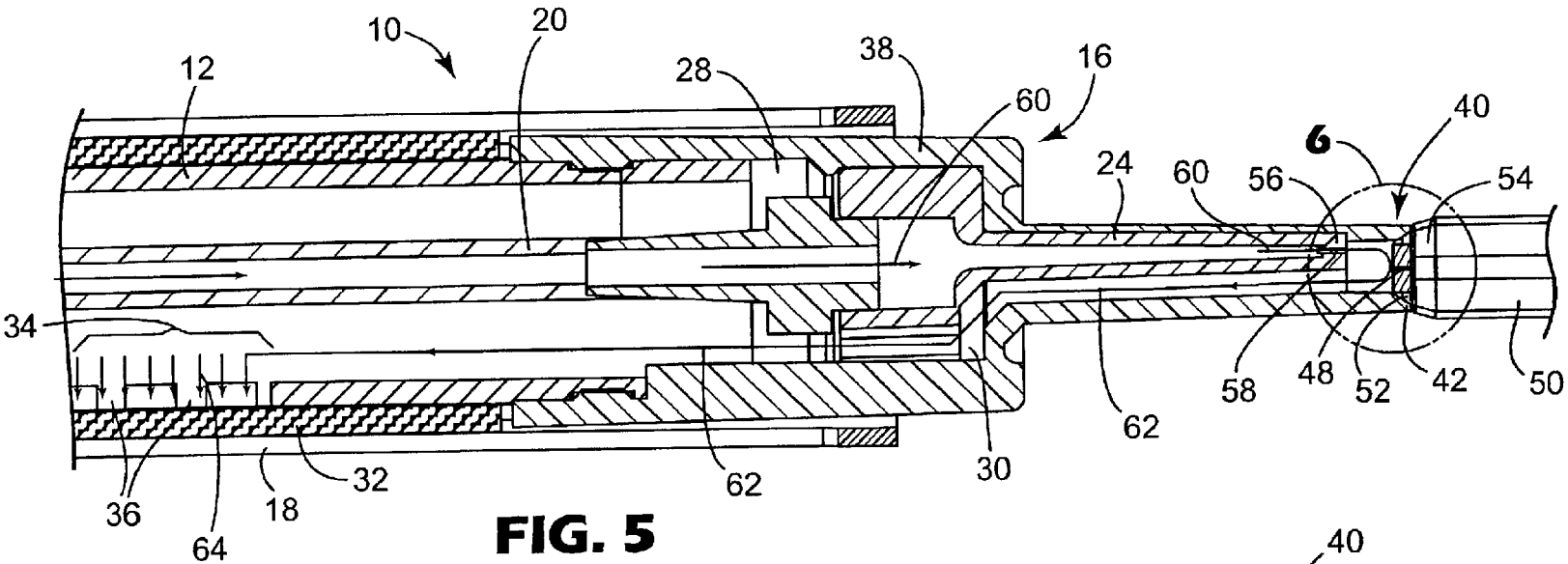
FIG. 5 provides a cross sectional view showing the relative positioning of an optical fiber connector and nozzle assembly during the process of liquid spray cleaning.
Figure 6:
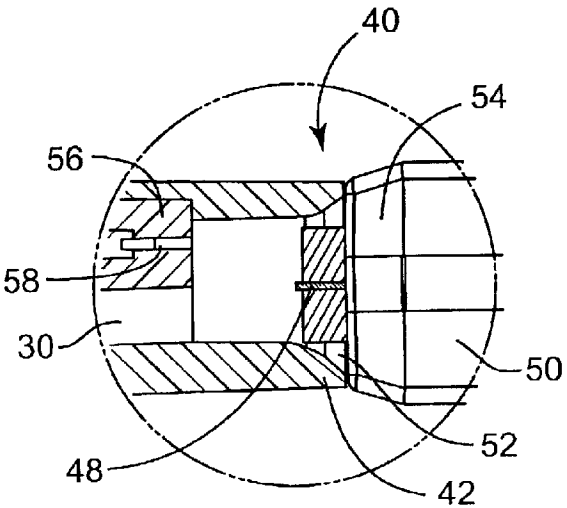
FIG. 6 is a cross sectional detail view, identified by numeral 6 in FIG. 5, showing the connection between a fiber optic connector and a nozzle assembly.

FIG. 5, shows detail of an nozzle assembly 16, attached to the end of a cover tube 12 for delivery of fluid from a fluid reservoir 14 via a delivery tube 20 through a nozzle 24 for application to a group of optical fiber surfaces 48 gathered as optical fiber ends inside an optical fiber connector 50 similar to that found in the backplane of a switch card cage. The contact end 40 receives the tip 52 of an optical fiber connector 50, holding it in spaced relationship from the nozzle 24. FIG. 6 shows the preferred arrangement of the optical fiber surfaces 48 and the nozzle end 56 from which liquid spray emerges to bathe the optical fiber surfaces 48. Suitable separation allows use of a liquid spray device 10 according to the present invention with optical fiber connectors 50 that may include protruding parts such as pins or the like extending in front of optical surfaces that require cleaning. When fully inserted, a shoulder portion 54 of the optical fiber connector 50 nestles against the peripheral seal 42 at the mouth of the contact end 40.

FIG. 5 includes lines showing the flow path of cleaning liquid during activation of a fluid spray device according to the present invention. Liquid delivered by the delivery tube 20, shown as line 60, exits through the nozzle orifice 58 to apply fluid to one or more optical fiber ends 48. After impinging on these optical surfaces 48, the liquid travels, as designated by flow line 62, through the return channel 30 to collect in the cover tube section 34 before exiting, according to lines 64, into an absorbent 32 via drain holes 36 or similar drainage structures including slits. The absorbent 32 remains with the fluid spray device 10 until it becomes saturated with liquid residues as described previously.

A fluid spray device 10 for cleaning inaccessible surfaces and its component parts have been described herein. Devices 10 according to the present invention facilitate liquid processing by incorporating a liquid reservoir and a liquid collection vessel in a self-contained structure. A self-contained structure, including one or more suitable cleaning ports, provides a convenient portable unit for delivery of liquid spray to surfaces inserted in a cleaning port. Portability is a particular benefit when conducting surface cleaning processes at relatively remote locations represented by field installed, optical fiber connection sites.

Considering the need for optimum surface cleaning, a fluid spray device 10 according to the present invention could find use in a kit with other cleaning utensils such as dry cleaning articles including dry fabric wiping systems and the like. A kit would have particular value based upon demonstrated benefits accruing from the use of wet and dry methods together compared to the efficacy of wet or dry methods alone. Assembly of both wet and dry cleaning components in kit form provides a two part cleaning process for restoring treated surfaces to an optimum condition of cleanliness. The process includes steps for wiping or rubbing a dry cleaner against an optical surface, to provide a suitably buffed optical surface, and applying a liquid cleaner to the buffed optical surface using a liquid spray device as described above.

Description of devices included herein is not intended to be limiting. Accordingly it will be appreciated by those skilled in the art, that other liquid spray devices are within the intended scope of this invention for general application to the cleaning of relatively inaccessible surfaces.

What is claimed is:

1. A spray device for cleaning at least one optical surface having limited access thereto, said spray device comprising:

a fluid reservoir;

a nozzle assembly communicating with said fluid reservoir to deliver liquid spray to at least one optical surface; and a cover tube having a first end and a second end and an inner wall and an outer wall, said nozzle assembly coupled to said first end of said cover tube and said fluid reservoir located adjacent to said second end of said cover tube;

wherein said nozzle assembly further includes a return channel to guide liquid residues toward an absorbent that is mounted adjacent to said outer wall of at least a portion of said cover tube after application of fluid to at least one optical surface.

2. The spray device of claim 1, wherein said liquid residues collect in said absorbent after passing through drain holes formed in said at least a portion of said cover tube.

3. A portable, self-contained spray device for cleaning at least one optical surface, said spray device comprising:

a fluid reservoir;

a cover tube having an inner wall, an outer wall, a first end and a second end;

a nozzle assembly at said first end of said cover tube, said nozzle assembly including a seal to provide substantially fluid-tight contact between said spray device and the optical surface;

a delivery tube, located inside said inner wall coaxial with said cover tube, said delivery tube coupled to said fluid reservoir to direct fluid towards said nozzle assembly; and an absorbent mounted adjacent to said outer wall of at least a portion of said cover tube to collect liquid residues after application of fluid to an optical surface.

4. The portable, self-contained spray device of claim 3, wherein said at least a portion of said cover tube has a plurality of drain holes formed therein to release said liquid residues for collection by said absorbent.

5. The portable, self-contained spray device of claim 4, wherein said nozzle assembly further includes a return channel to direct said liquid residues for collection by said absorbent.

6. The portable, self contained spray device of claim 3, wherein said nozzle assembly includes a shroud overlapping said first end of said cover tube, said shroud providing containment for a nozzle having a nozzle end including a shaped orifice, said delivery tube being connected to said nozzle to deliver fluid, from said fluid reservoir, to provide said liquid spray emitting from said nozzle end in a pattern according to said shaped orifice.

7. The portable, self-contained spray device of claim 6, wherein said shaped orifice comprises an orifice selected from the group consisting of circular orifices, elliptical orifices, rectangular orifices, oblong orifices and combinations thereof.

8. A spray device for cleaning at least one optical surface having limited access thereto, said spray device comprising:

a fluid reservoir;

a cover tube having an inner wall, an outer wall, a first end and a second end;

a nozzle assembly at said first end of said cover tube, said nozzle assembly including a seal to provide substantially fluid-tight contact between said spray device and the optical surface;

a delivery tube, located inside said inner wall coaxial with said cover tube, said delivery tube coupled to said fluid reservoir to direct fluid towards said nozzle assembly; and an absorbent cartridge mounted adjacent to said outer wall of at least a portion of said cover tube to collect liquid residues after application of fluid to an optical surface, said absorbent cartridge comprising a detachable jacket surrounding an absorbent.

9. The spray device of claim 8, wherein said detachable jacket has openings formed therein to facilitate evaporation of liquid from said absorbent.

* * * * *